US012514312B2

(12) United States Patent
Ernst et al.

(10) Patent No.: US 12,514,312 B2
(45) Date of Patent: Jan. 6, 2026

(54) GOLF GLOVE

(71) Applicant: Grab Perfect GmbH, Dillenburg (DE)

(72) Inventors: Finn-Lasse Ernst, Waldsolms (DE); Leon Reeh, Dillenburg (DE)

(73) Assignee: Grab Perfect GmbH, Dillenburg (DE)

( * ) Notice: Subject to any disclaimer, the term of this patent is extended or adjusted under 35 U.S.C. 154(b) by 79 days.

(21) Appl. No.: 17/965,040

(22) Filed: Oct. 13, 2022

(65) Prior Publication Data

US 2023/0134158 A1 May 4, 2023

(30) Foreign Application Priority Data

Nov. 1, 2021 (EP) ..... 21205813

(51) Int. Cl.
*A41D 19/00* (2006.01)

(52) U.S. Cl.
CPC ..... *A41D 19/0051* (2013.01)

(58) Field of Classification Search
CPC ... A41D 19/00; A41D 19/0051; A63B 71/146
See application file for complete search history.

(56) References Cited

U.S. PATENT DOCUMENTS 4,519,781 A * 5/1985 Boyd ..... G09B 21/009 2/160
5,184,353 A * 2/1993 Goldwitz ..... A63B 71/146 2/160
6,415,445 B1 * 7/2002 Nishijima ..... A63B 71/146 2/161.4
6,427,249 B1 * 8/2002 Mattesky ..... A41D 19/01505 2/161.6
6,513,166 B1 * 2/2003 Landis ..... A41D 19/01547 2/205
6,964,063 B2 * 11/2005 Bamber ..... A63B 63/007 2/161.1
2004/0025225 A1 * 2/2004 Thompson ..... A63B 71/146 2/161.4
2008/0109933 A1 * 5/2008 Dolenak ..... A41D 19/01547 2/159
2009/0139008 A1 * 6/2009 Drab ..... A63B 71/146 2/161.3
2010/0192280 A1 * 8/2010 McClard ..... B44C 1/1712 428/172

(Continued)

FOREIGN PATENT DOCUMENTS

DE 298 14 149 U1 2/1999
DE 20 2010 005 340 U1 6/2010

(Continued)

OTHER PUBLICATIONS

European Search Report dated Apr. 4, 2022 in European Application No. 21205813.5 with English translation of relevant parts.

*Primary Examiner* — Uyen T Nguyen
(74) *Attorney, Agent, or Firm* — Collard & Roe, P.C.

(57) ABSTRACT

A golf glove with marking areas provided on an outer surface of the hand and on an inner surface of the hand has three markings, wherein a first marking is provided on the outer surface of the hand in the metacarpal region, wherein a second marking is provided on the outer surface of the hand, and wherein a third marking is provided on the inner surface of the hand.

5 Claims, 5 Drawing Sheets

(56) References Cited

U.S. PATENT DOCUMENTS

| | | | | |
|---|---|---|---|---|
| 2014/0026281 | A1* | 1/2014 | Kleinert | A63B 71/146 2/163 |
| 2015/0196830 | A1* | 7/2015 | Lien | A41D 19/0024 2/161.1 |
| 2016/0354673 | A1* | 12/2016 | Machado | A41D 19/00 |
| 2019/0014838 | A1* | 1/2019 | Price | A41D 27/28 |

FOREIGN PATENT DOCUMENTS

| | | | |
|---|---|---|---|
| GB | 2 366 990 | A | 3/2002 |
| KR | 2002-0065443 | A | 8/2002 |

* cited by examiner

GOLF GLOVE

CROSS REFERENCE TO RELATED APPLICATIONS

Applicant claims priority under 35 U.S.C. § 119 of European Application No. 21205813.5 filed Nov. 1, 2021, the disclosure of which is incorporated by reference.

BACKGROUND OF THE INVENTION

1. Field of the Invention

The invention relates to a golf glove.

2. Description of the Related Art

In the sport of golf, it is important to grip the club properly.

With a so-called "neutral" grip, one of the main sources of error is eliminated and the probability that the ball will fly toward the intended target is increased. With a "weak" grip, the ball tends to fly to the right. With a "strong" grip, the ball tends to fly to the left. As used here, "strong" and "weak" describe how the hands are positioned on the club. The position of the hands on the club influences the angle of the clubhead at the moment of impact with the ball.

With the neutral grip, the clubhead at the moment of impact has an alignment in which a longitudinal axis of the clubhead is disposed perpendicular to the desired direction of flight of the golf ball. The longitudinal axis and the desired direction of flight include an angle of 90°.

With the "strong" or "weak" grip, the longitudinal axis of the clubhead is not disposed at an angle of 90° to the desired direction of flight, but instead the angle is larger or smaller. In this case, the clubhead is "open" or "closed".

For this reason, it is important for the golfer to achieve a so-called neutral grip, meaning a grip on the grip of the club that is neutral relative to the swing.

Even for experienced golfers, but especially for beginners, it is difficult to position the hands and fingers in such a way on the grip of the club that a neutral grip is present.

The prior art (DE 298 14 149 U1) discloses a golf glove that has, at various positions of the glove, markings that mark a correct position on the grip of the club. One part of the marking is provided on the inner surface of the hand. The marking is formed from a positioning area extending on both sides of the transition between palm of the hand and bases of the fingers, distinguished at least by color from the glove material and has a width from the index finger to the little finger. Another part of the marking is formed on the back of the hand from a checking area, which extends from the connecting region between thumb and index finger in the shape of a Y formed by the index finger and the thumb.

This checking area belonging to the prior art permits the golfer to assume a correct positioning of the fingers when the triangle is closed. The marking shows the golfer where the club is supposed to rest in the hand. Thus the markings predetermine how the fingers are supposed to be positioned correctly around and on the golf club. This golf glove belonging to the prior art does not provide any assistance in relation to the alignment of the clubhead.

Furthermore, a practice and training device for the sports instruction belongs to the prior art (DE 20 2010 005 340 U1). According to this prior art, a golf glove is disclosed that has a visual indicator, which follows the movement of the body part with a limit marking of a movement fixed in position relative to the body part. With this golf glove belonging to the prior art, it is possible to check the movement of the body part or the posture of the body part better. With the glove, it is possible, for example, that the athlete is able to detect by means of the glove whether the club strikes the ball in the desired orientation or which changes in comparison with the previous stroke the orientation of the clubhead will have. According to this prior art, however, no assistance for a correct grip will be imparted to the athlete.

The golf gloves belonging to the prior art do not permit any check of a so-called neutral grip.

SUMMARY OF THE INVENTION

The technical problem underlying the invention consists in specifying a golf glove that has marking areas with which it may be visually checked whether a so-called neutral grip is present.

This technical problem is solved by a golf glove having the features according to the invention.

The golf glove according to the invention, with marking areas provided on an outer surface of the hand and on an inner surface of the hand, wherein the golf glove has three markings, is characterized

- in that a first marking is provided on the outer surface of the hand in the metacarpal region, in that the at least one marking area of the first marking is formed in a manner overlapping the base knuckles of an index finger and middle finger or in an at least partly overlapping manner, and in that the marking area in the region of the base knuckles of a ring finger and little finger is formed in a manner leaving the base knuckles uncovered and is disposed in a manner extending to the metacarpus, and
- in that a second marking is provided on the outer surface of the hand, in a manner having respectively at least one marking area on the index finger, on the middle finger, on the ring finger and on the little finger, which marking is disposed between a top knuckle and a middle knuckle or which is formed in a manner at least partly overlapping a top knuckle, and
- in that a third marking is provided on the inner surface of the hand for the index finger, the middle finger and the ring finger, having respectively one marking area, which marking is formed in a manner covering a fingertip and extending at least to the top knuckle, and in that a marking area is provided for the little finger between the top knuckle and the middle knuckle.

This special combination of marking areas on the golf glove permit a golfer to check visually whether he has a so-called neutral grip, meaning a grip that is neutral relative to the swing.

The various marking areas on the glove are configured in such a way that exclusively the basic color of the glove is to be seen in the presence of the neutral grip. The marking areas distinguished by color are not to be seen by the golfer when a neutral grip is present.

If the basic color of the glove is white, for example, and the marking areas are formed in black, the golfer sees exclusively white surfaces of the glove when he has assumed the correct grip position for the neutral grip.

The first marking is disposed in the region of the base knuckles. With a neutral grip, the player should not see the base knuckles of the index finger and of the middle finger, so that the marking area in this region is formed in a manner covering the base knuckles at least partly. This means that the marking area in this region partly overlaps the base knuckles at least partly. Advantageously, the marking areas overlap the base knuckles of the index finger and of the middle finger completely.

For the ring finger and the little finger, the base knuckles should be visible with a neutral grip. For this reason, the marking area in the region of the ring finger and of the little finger is formed in a manner leaving the base knuckles uncovered. The marking area extends in the direction of the back of the hand, in a manner offset relative to the base knuckles of the ring finger and of the little finger. This marking area is disposed on the back of the hand.

The second marking is likewise disposed on the outer surface of the hand. This marking is situated in the region of the fingers. For each finger, a marking area is provided that either is disposed respectively between the top knuckle and the middle knuckle and/or is formed in a manner overlapping a top knuckle. With a neutral grip, these marking areas are likewise not visible.

The third marking is provided on the inner surface of the hand. For the index finger, the ring finger and the middle finger, respectively one marking area is provided that is formed in a manner covering a fingertip and extending at least to the top knuckle. This means that the fingertips have marking areas. For the little finger, a marking area is provided that is disposed between the top knuckle and the middle knuckle. If the fingers are placed correctly around the grip of the club and the fingers are sufficiently closed, the player does not see the marking areas of the third marking.

The golf glove according to the invention is advantageously usable for training purposes. Beginner golfers in particular often do not know how the hands and the fingers are to be positioned on the grip of the golf club in order to obtain a neutral grip. However, a faulty grip has the consequence that the golfer will not strike the ball correctly. With the neutral grip, one of the main sources of error is eliminated and the probability for a stroke that hits the target is increased. A too-weak grip may cause a curve to the right; a too-strong grip may cause a curve to the left. For this reason, it is important for beginner golfers in particular but also for longtime golfers to train themselves for a neutral grip.

For advanced golfers, it is helpful beyond this to check the neutral grip at least from time to time.

According to an advantageous embodiment of the invention, it is provided that the marking area of the third marking for the index finger or the middle finger or the ring finger is formed in a manner covering the fingertip and extending over the top knuckle.

Not all marking areas of the third marking have to overlap the top knuckles. It is important that the fingertips of the index finger, middle finger and ring finger have a marking, since these fingers wrap around the grip of the club and should not remain open.

According to an advantageous embodiment of the invention, it is provided that the marking areas are formed as continuous marking areas or as discontinuous marking areas.

In principle, the possibility exists of forming the marking areas from one uninterrupted area. The marking areas are distinguished by color from the basic color of the golf glove. For example, stripes or bars may be provided as marking areas of the first marking and of the second marking. The stripes or bars are advantageously so broad that, for example, they are formed in a manner overlapping the base knuckles.

The fingertips, which according to the third marking are provided for the index finger, middle finger and ring finger, are advantageously configured two-dimensionally. The marking area of the third marking for the little finger is advantageously formed as bars or stripes.

These bars, stripes or areas may also be formed by discontinuous markings. For example, dotted markings, hatched markings or the like may be provided.

In order to impart an esthetically attractive appearance to the golf glove, these markings may also have different patterns, for example triangles, flowers or the like.

If the marking areas are formed as stripes or bars, they may also be formed, for example, in discontinuous manner, for example as dot-dash stripes or bars.

According to an advantageous embodiment of the invention, the first and/or the second marking has linear marking areas.

In order to achieve a neutral grip or to deviate from the neutral grip, sometimes merely nuances in the hand and finger posture are decisive. For this reason, these markings are advantageously formed in stripe-like and bar-like manner.

The same applies for the third marking as regards the little finger, which likewise advantageously has a stripe-like or bar-like marking area.

According to a further advantageous embodiment of the invention, it is provided that the marking areas of the third marking of the index finger, middle finger and ring finger are formed as two-dimensional marking areas.

The tips of the index finger, middle finger and ring finger on the inner surface of the hand are completely overlapped with the marking areas. The marking areas extend from the fingertips at least to the top knuckle.

A further advantageous embodiment of the invention provides that the marking areas are distinguished by color from the golf glove.

The golf glove advantageously has one or more basic colors.

The marking areas are advantageously configured in a color different from the basic color of the glove. Hereby the marking areas are visually distinguished from the basic color of the golf glove.

A further advantageous embodiment of the invention provides that the marking areas are formed as colored areas.

As already stated, the marking areas advantageously have a color different from the basic color of the golf glove.

During production, it is particularly easy to color the marking areas and hereby distinguish them visually.

In principle, the possibility exists of forming the marking areas from stitched or glued material, for example.

Advantageously, the golf glove consists at least partly of an elastic material, so that the necessary mobility of the hand in the glove is assured.

According to a further advantageous embodiment of the invention, the golf glove consists or plastic and/or leather and/or a mesh material.

As a rule, the golf glove consists of a preferably elastic plastic, for example as imitation leather.

The glove may also consist of leather.

Especially for the summer, a mesh material is often used, especially on the outer surface of the hand, so that some UV light is able to pass through the mesh material.

According to a further advantageous embodiment of the invention, the marking areas are formed as review areas for visual checking of a correct hand posture on a grip of the club for a neutral grip.

When the hand wearing the glove is correctly positioned on the grip of the club, the marking areas are not visible, but instead only the basic color of the golf glove is perceptible.

Hereby a golfer himself is able to check that he has a so-called neutral grip.

For a right hander, the left hand is first to grip the club. During gripping, the two large balls of the hand are placed on the grip. Since in this position the player should not see the base knuckles of the index finger and of the middle finger, this is achieved by the marking areas of the glove according to the invention in the simplest way. Due to the marking areas in the region of the fingers, the correct position of the hand and of the fingers on the grip of the club can likewise be checked.

The golf glove according to the invention may be configured for right handers or for left handers, meaning for the left hand or the right hand.

In the present Application, a distinction is made between the base knuckle, the middle knuckle and the top knuckle. The top knuckle is situated on the distal part of the hand. The base knuckle is situated on the proximal part of the hand and the middle knuckle is disposed between base knuckle and top knuckle.

The thumb is not included in the term "finger".

According to a further advantageous embodiment of the invention, a closure may be disposed on the glove. The closure consists, for example, of a hook-and-loop strap. The closure can be opened in order to put on the glove. After the glove has been put on, the closure is closed, so that the glove fits securely on the hand.

According to the invention, three markings are disposed on the golf glove. The markings may consist respectively of one or more marking areas. The marking areas of a marking may be disposed on various parts of the hand, for example on different fingers. The term marking merely denotes various regions on the hand where the marking areas of the respective marking are disposed.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
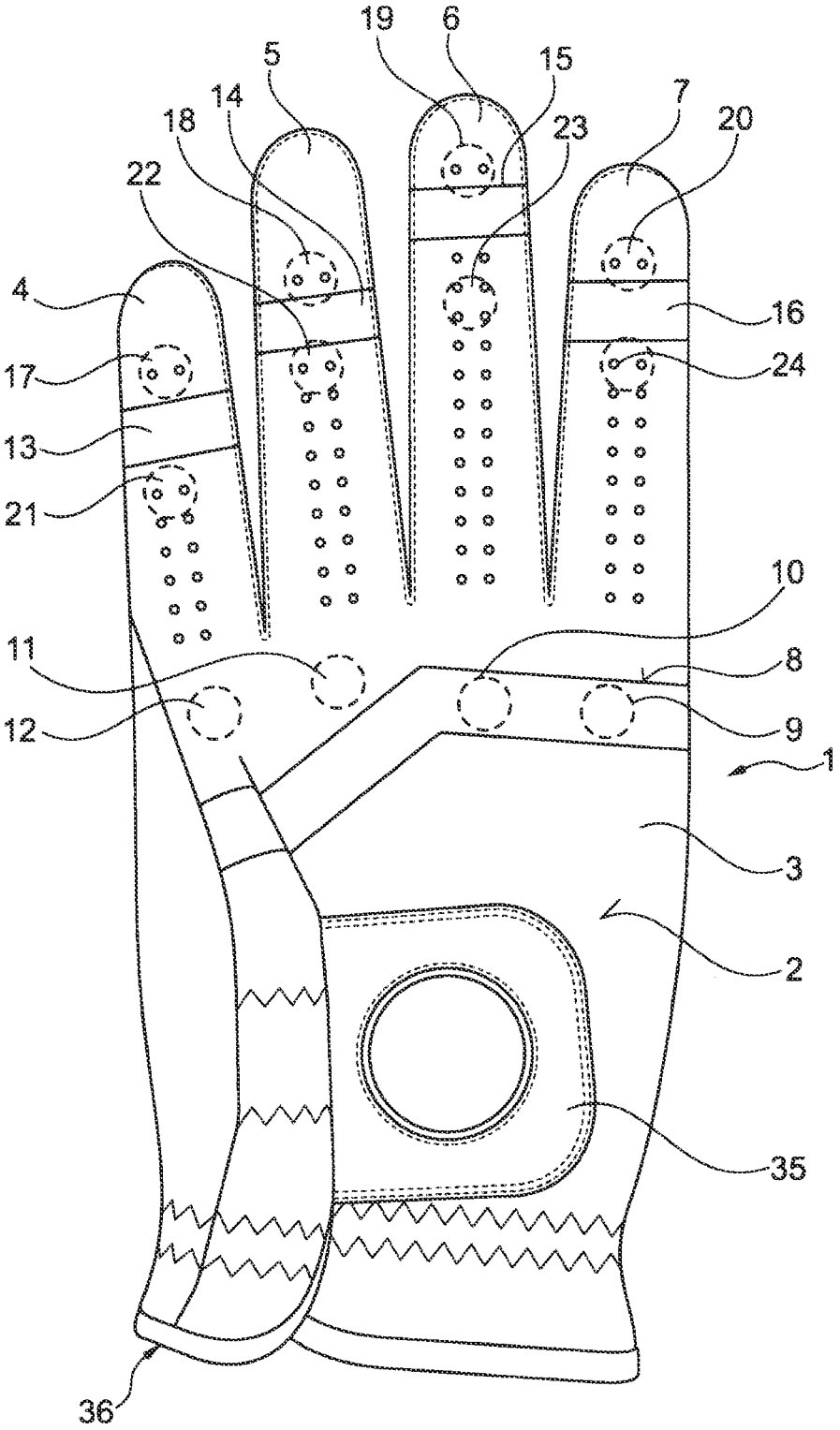
FIG. 1 shows a glove in top view of the outer surface of the hand.

FIG. 1 shows a golf glove 1 with an outer surface 2 of the hand. The golf glove 1 is formed as a finger glove. A metacarpus (not illustrated) of a golfer is disposed in the region 3 of the glove. A little finger is disposed in a finger 4, a ring finger in a finger 5, a middle finger in a finger 6 and an index finger in a finger 7. The thumb is not visible in FIG. 1. The thumb is visible in FIGS. 2 and 3.

The outer surface 2 of the hand of the glove 1 has a first marking with a marking area 8. The marking area 8 completely covers base knuckles 9, 10 of the index finger 7 and of the middle finger 6, which are illustrated merely schematically. Base knuckles 11, 12 of the ring finger 5 and of the little finger 4 are left uncovered by the marking area 8, meaning that they are not overlapped, not even partly. In the region of the base knuckles 11, 12 of the ring finger 5 and of the little finger 4, the marking extends to a back of the hand.

The marking area 8 helps in the positioning of the hand (not illustrated) on a club grip.

A second marking has marking areas 13, 14, 15, 16. The marking area 13 is disposed on the little finger 4, the marking 14 on the ring finger 5, the marking area 15 on the middle finger 6 and the marking area 16 on the index finger 7. The marking areas 13, 14, 16 are disposed between a top knuckle 17, 18, 20 and a middle knuckle 21, 22, 24. The marking area 15 partly covers the top knuckle 19 of the middle finger 6 and extends in the direction of the middle knuckle 23.

If a club grip (not illustrated) of a golf club (likewise not illustrated) is gripped with the hand that wears the glove 1, the fingers 4, 5, 6, 7 wrap around the grip. If the left hand, for example, that is wearing the golf glove 1 illustrated in FIG. 1 is angled too far to the left, the golfer sees the marking areas 13, 14, 15, 16, so that the hand with the glove 1 must be rotated into a neutral position, so that the marking areas 13, 14, 15, 16 are no longer seen by the golfer.

If the hand is angled to the right, the golfer would see the marking area 8, so that the hand should be moved into the middle position, meaning the neutral position, so that the golfer sees neither the marking area 8 nor the marking areas 13, 14, 15, 16. In this case, the golfer has assumed the neutral position with the hand wearing the golf glove 1.

The marking area 8 is formed as a bar. The bar extends in the region of the index finger 7 and of the middle finger 6, in a manner connecting the regions covering the base knuckles 9, 10. In the region between ring finger 5 and middle finger 6, the bar 8 angles off in the direction of the back of the hand, meaning in the direction of the body of the golfer, and extends over the back of the hand. Thus the marking area 8 leaves the base knuckles 11, 12 of the ring finger 5 and of the little finger 4 uncovered.

The golf glove 1 has a closure 35. The closure 35 can be opened in order to put on the golf glove 1. After the golf glove 1 has been put on, the closure is closed.

Beyond that, the golf glove 1 has an opening 36, through which a hand (not illustrated) of a golfer can be introduced into the golf glove.

Figure 2:
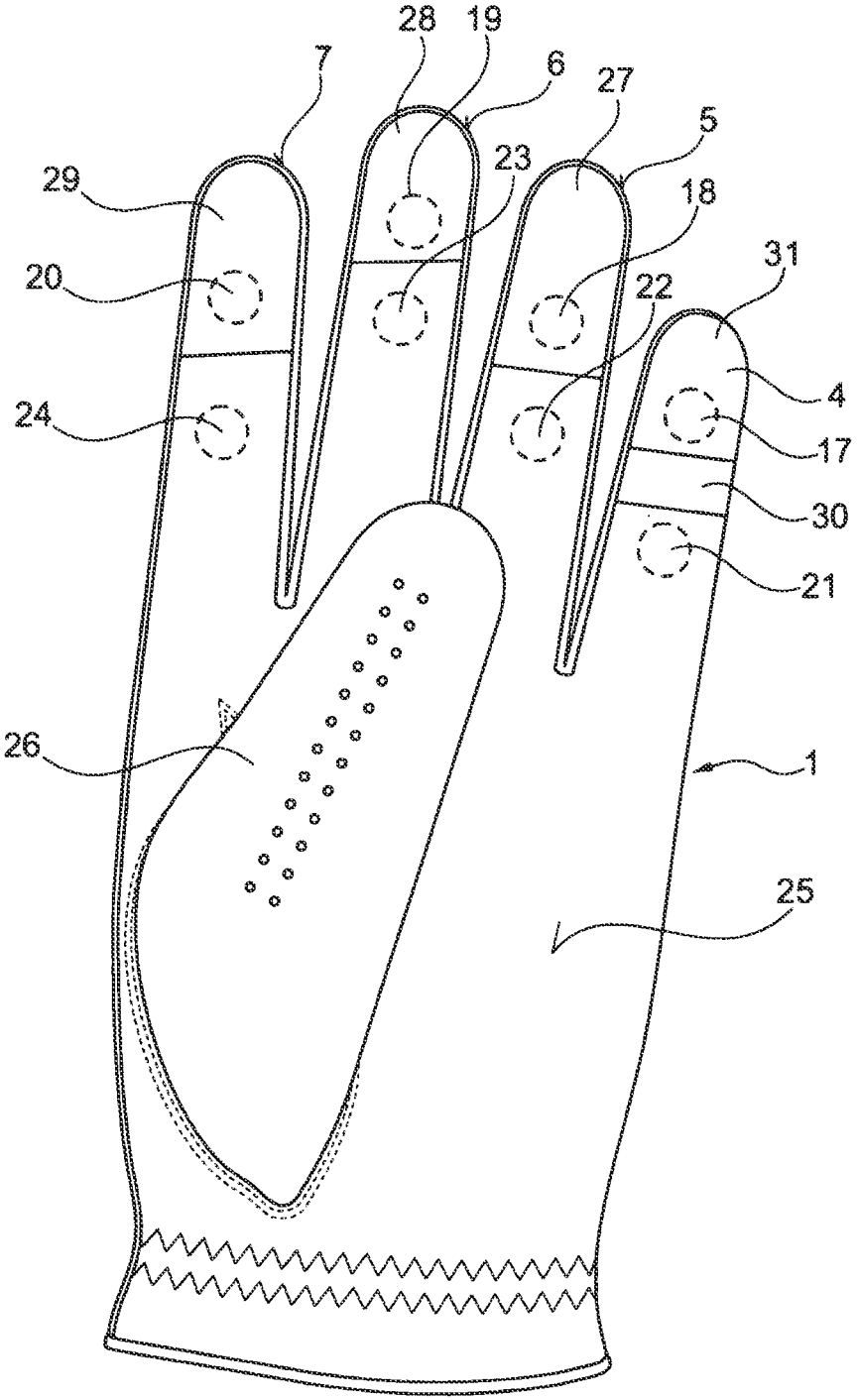
FIG. 2 shows a top view of the inner surface of the hand of a glove.
Figure 3:
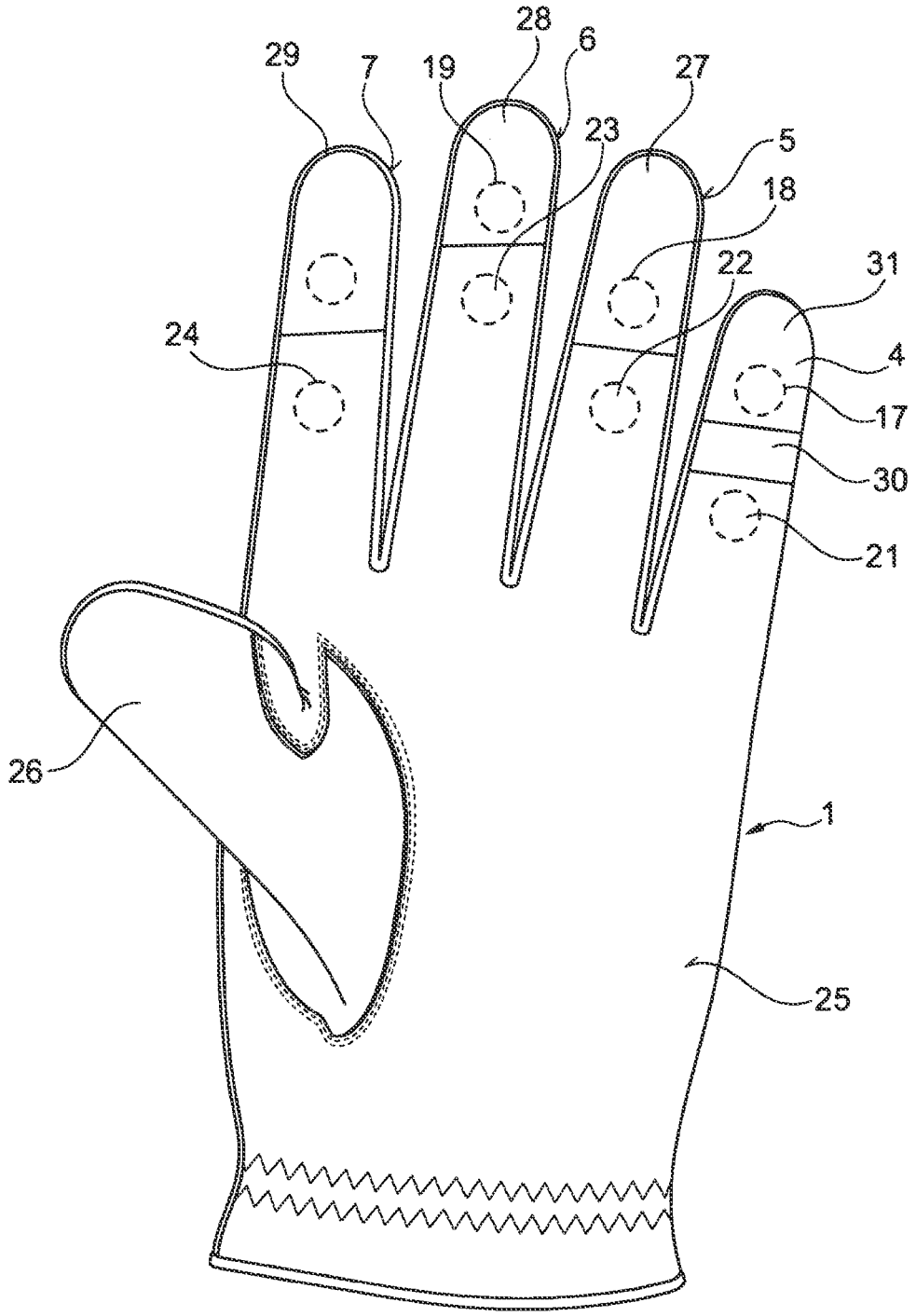
FIG. 3 shows a top view of the glove according to FIG. 2 with thumb angled outward.

FIG. 2 shows the golf glove 1 with an inner surface 25 of the hand. In FIG. 2, the fingers 4, 5, 6, 7 are illustrated, as is the thumb 26. According to FIG. 3, the glove 1 is likewise illustrated with the inner surface 25 of the hand, the fingers 4, 5, 6, 7 and the thumb 26. The fingers 4, 5, 6, 7 have a third marking. For the index finger 7, the middle finger 6 and the ring finger 5, marking areas 27, 28, 29 are provided that cover the fingertips. The marking areas 27, 29 completely overlap the top knuckles 18, 20 of the ring finger 5 and of the index finger 7. The marking area 28 overlaps the top knuckle 19 of the middle finger 6 only partly. The middle knuckles 22, 23, 24 are not overlapped by the marking areas 27, 28, 29, not even partly.

The little finger 4 has a marking area 30 between the top knuckle 17 and the middle knuckle 21.

If the neutral grip is achieved, the index finger 7, the middle finger 6 and the ring finger 8 must wrap so far around the club that the marking areas 27, 28, 29 are not visible. The little finger 4 may be slightly open. For this reason, the fingertip 31 of the little finger 4 is not provided with a marking area. However, the little finger 4 should not be so far open that the marking area 30 is visible to the golfer.

Figure 4:
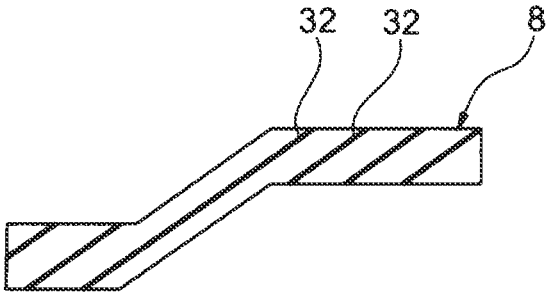
FIG. 4 shows a modified exemplary embodiment of the marking area 8.

FIG. 4 shows the marking area 8, which is provided with a hatching 32. The remaining marking areas 13, 14, 15, 16, 27, 28, 29, 30 may also be formed by a hatching.

Figure 5:
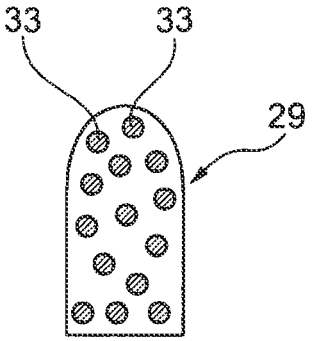
FIG. 5 shows a modified exemplary embodiment of the marking area 29.

FIG. 5 shows the marking area 29. The marking area 29 is formed from dots 33. The remaining marking areas 8, 13, 14, 15, 16, 27, 28, 30 may also be formed in this way.

Figure 6:
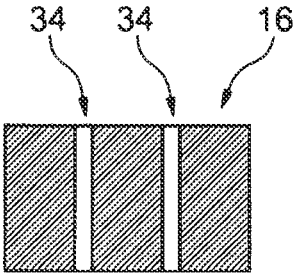
FIG. 6 shows a modified exemplary embodiment of the marking area 16.

FIG. 6 shows the marking area 16. The marking area 16 has discontinuities 34. The marking areas 13, 14, 15, 27, 28, 29 and 30 may also be formed in this way.

The marking areas 8, 13, 14, 15, 16, 27, 28, 29, 30 may also have other configurations. For example, these marking areas may have a pattern. This pattern may also correspond to a pattern on golf apparel, for example to a patterned polo shirt.

Figure 7:
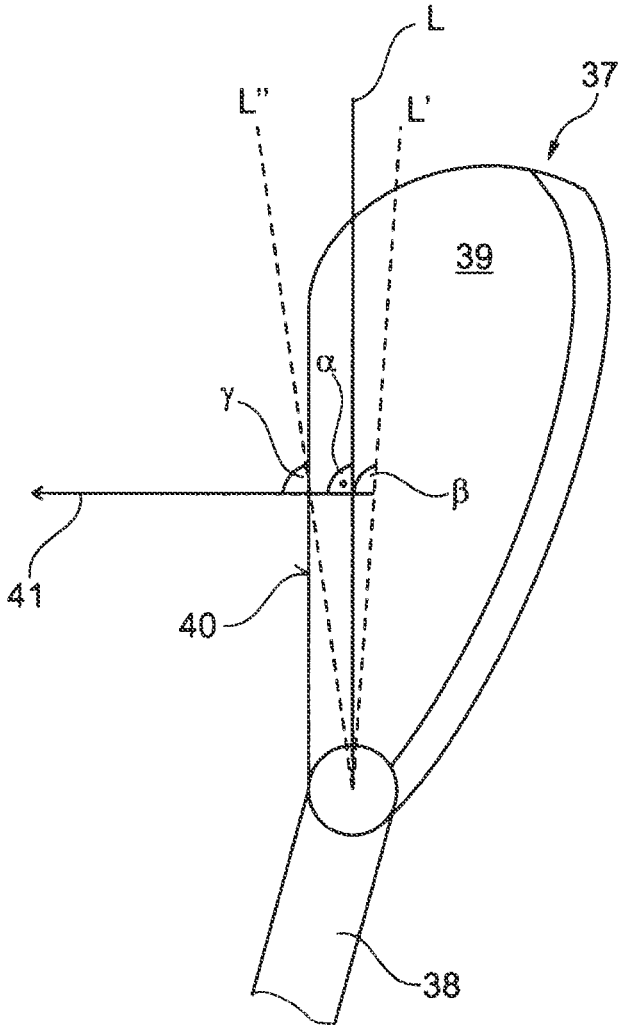
FIG. 7 shows a top view of a clubhead.

FIG. 7 shows a clubhead 37. The clubhead 37 is illustrated as a golfer would see it. The clubhead is mounted on a shaft 38, which is not completely illustrated.

The clubhead 37 has a clubface 39. The clubhead 37 is placed with a sole 40 on the ground on which the ball is lying (not illustrated).

The clubhead 37 has a longitudinal axis L. The longitudinal axis L should be aligned at right angles to a desired direction of flight 41 of a ball. If the longitudinal axis L is aligned with an angle $\alpha$ equal to an angle of 90 degrees relative to the desired direction of flight 41, the clubhead 37 has a so-called neutral position.

If the clubhead 37 is aligned with the longitudinal axis L in the position L', the grip on the club is said to be a weak grip and the ball tends to fly to the right. The angle $\beta$ included between the longitudinal axis L' and the desired direction of flight 41 is larger than 90 degrees.

If the golfer has a too-strong grip, the longitudinal axis is aligned in the position L". An angle $\gamma$, which is smaller than 90 degrees, is included between the longitudinal axis L" and the desired direction of flight. In this case, the ball would tend to fly to the left as seen by the golfer.

The golf glove 1 according to the invention helps the golfer to assume the neutral grip with the corresponding grip of the hand on the grip of the club and the check via the marking areas, so that the longitudinal axis L of the clubhead 37 is disposed at right angles or at approximately right angles to the desired direction of flight 41 of the ball.

Although only a few embodiments of the present invention have been shown and described, it is to be understood that many changes and modifications may be made thereunto without departing from the spirit and scope of the invention.

REFERENCE SYMBOLS

1 Golf glove
2 outer surface of the hand
3 Metacarpal region
4 Finger of the golf glove (little finger)
5 Finger of the golf glove (ring finger)
6 Finger of the golf glove (middle finger)
7 Finger of the golf glove (index finger)
8 Marking area
9 Base knuckle of index finger
10 Base knuckle of middle finger
11 Base knuckle of ring finger
12 Base knuckle of little finger
13 Marking area of little finger
14 Marking area of ring finger
15 Marking area of middle finger
16 Marking area of index finger
17 Top knuckle of little finger
18 Top knuckle of ring finger
19 Top knuckle of middle finger
20 Top knuckle of index finger
21 Middle knuckle of little finger
22 Middle knuckle of ring finger
23 Middle knuckle of middle finger
24 Middle knuckle of index finger
25 Inner surface of the hand of the golf glove
26 Thumb
27 Marking area of the fingertip of the ring finger
28 Marking area of the fingertip of the middle finger
29 Marking area of the fingertip of the index finger
30 Marking area of the little finger
31 Fingertip
32 Hatching
33 Dots
34 Interruption
35 Closure
36 Opening
37 Clubhead
38 Shaft
39 Clubface
40 Sole of the clubhead
41 Desired direction of flight of the ball
L Longitudinal axis
L' Longitudinal axis
L" Longitudinal axis
$\alpha$ Angle
$\beta$ Angle
$\gamma$ Angle

The invention claimed is:

1. A golf glove having an exterior surface comprising an outside and an inside, with marking areas configured to be provided on an outer surface of a hand and on an inner surface of the hand, wherein the golf glove has three markings, wherein a first marking exclusively on the outside of the golf glove and extending across a width of the golf glove on the outside of the golf glove is designed as a continuous bar and is configured to be provided on the outer surface of the hand in a metacarpal region, wherein the first marking is formed in a manner configured to overlap base knuckles of an index finger and middle finger, and wherein the first marking in a region of base knuckles of a ring finger and little finger is formed in a manner configured to leave the base knuckles of the ring finger and the little finger uncovered and is disposed in a manner configured to extend to a metacarpus, and a second marking exclusively on the outside of the golf glove is designed as at least one bar-shaped marking area and is configured to be provided on the outer surface of the hand, in a manner configured to have respectively the at least one bar-shaped marking area disposed exclusively between a finger end joint and a finger middle joint on the index finger, on the middle finger, on the ring finger and on the little finger or to cover at least part of the finger end joint on the index finger, on the middle finger, on the ring finger and on the little finger, and a third marking exclusively on the inside of the golf glove comprising an index finger third marking area, a middle finger third marking area, a ring finger third marking area, and a little finger third marking area, wherein the index finger third marking area is configured to be provided on the inner surface of the hand for the index finger and to cover a fingertip of the index finger exclusively on the inside of the golf glove and extend over the finger end joint of the index finger, wherein the middle finger third marking area is configured to be provided on the inner surface of the hand for the middle finger and to cover a fingertip of the middle finger exclusively on the inside of the golf glove and extend over the finger end joint of the middle finger, and wherein the ring finger third marking area is configured to be provided on the inner surface of the hand for the ring finger and to cover a fingertip of the ring finger exclusively on the inside of the golf glove and extend over the finger end joint of the ring finger wherein the little finger third marking area is designed as a bar-shaped marking area configured to be provided between the finger end joint and the finger middle joint of the little finger and configured to leave uncovered a fingertip on the inner surface of the little finger.

2. The golf glove according to claim 1, wherein the marking areas of the third marking of the index finger, middle finger and ring finger are formed as two-dimensional marking areas.

3. The golf glove according to claim 1, wherein the first, second, and third markings are distinguished by color from the golf glove.

4. The golf glove according to claim 1, wherein the golf glove comprises an elastic material.

5. The golf glove according to claim 1, wherein the golf glove comprises plastic and/or leather and/or mesh material.

* * * * *